United States Patent [19]

Hsu

[11] Patent Number: 4,951,829

[45] Date of Patent: Aug. 28, 1990

[54] EASY OPENING CROWN CAP

[76] Inventor: Shih C. Hsu, 14th Floor, No. 18, Alley 4, Lane 995, Min Sheng East Road, Taipei, Taiwan

[21] Appl. No.: 356,321

[22] Filed: May 23, 1989

[51] Int. Cl.[5] ..... B65D 41/42

[52] U.S. Cl. ..... 215/253; 215/305

[58] Field of Search ..... 215/253, 254, 305

[56] References Cited

U.S. PATENT DOCUMENTS

| | | | |
|---|---|---|---|
| 1,706,720 | 3/1929 | Wettstein | 215/305 |
| 2,156,258 | 5/1939 | Atwood | 215/253 X |
| 3,187,919 | 6/1965 | Inglis | 215/305 |
| 3,207,351 | 9/1965 | Stuart | 215/254 |
| 4,098,420 | 7/1978 | Torii | 215/253 |

FOREIGN PATENT DOCUMENTS

| | | | |
|---|---|---|---|
| 1430724 | 1/1966 | France | 215/305 |

*Primary Examiner*—Donald F. Norton

*Attorney, Agent, or Firm*—Wenderoth, Lind & Ponack

[57] ABSTRACT

A crown cap for sealing bottles comprising a cap body including substantially a flat top, a crimped portion formed on the periphery of the cap body and an outwardly extending finger tab integrally connected to a part of the crimped portion and having a width of about 5 to 7 included teeth. A small notch is formed at the intersection between the basal end of the finger tab and the crimped portion, from which a score line extends upwardly along the crimped portion and passes slightly across the peripheral curved portion of the flat top and has an appropriate depth. The finger tab is formed at the margin with a pleated portion to strengthen the rigidity. The score line may be curved at the terminal end towards any of one side on the right or the left and may be additionally provided with a short score line perpendicular to the first score line. In this construction, the crown cap can be easily opened off of the mouth of a bottle by pulling the finger tab over with fingers.

18 Claims, 6 Drawing Sheets

EASY OPENING CROWN CAP

BACKGROUND OF THE INVENTION

The present invention relates to a crown closure, particularly, to an easy opening crown cap for sealing bottles, which, departing totally from the conventional hand-open types where the pull-to-open or tearing off technical art is followed, employs a novel pull-it-over technical concept.

The crown cap of the present invention includes a cap body having substantially a flat top, a crimped portion formed on the periphery of the cap body and an outwardly extending finger tab integrally joined to a part of the crimped portion.

Crown caps, being the most simple and economic in construction, are employed for sealing liquid containers like wine bottles, sauce bottles or aerated water bottles. In general, a crown cap is made of a tinned plate in a cap shape, and relying totally on the twenty-one included teeth in the crimped portion, closely embraces the protruding ring at the mouth of the bottle due to the flexibility and elasticity of the metal and tightly seals the mouth of the bottle to provide air-tightness or liquid-tightness due to the gasket or disc inside its flat top. Although the crown cap is simple in construction and has a wonderful function, on opening the bottle, a tool, such as an opener, is required for pulling the included teeth apart from the protruding ring at the mouth of the bottle in order to separate the cap from the bottle mouth.

There has since been much research in regard to how a crown cap can be easily opened out without having to rely on a tool. Among the prior art in the field are, for example, U.S. Pat. Nos. 3,382,997 to Tsuji and 3,937,349 to the present applicant, which disclose different designs of crown closure with easy open means for bottles. However, since most of these crown caps are formed by stamping of tinned plate, which is of relatively hard material, to split open the caps with a finger tab or pull ring has not been that simple, particularly because the purpose of opening the bottle can not be accomplished if the pulling force applied is insufficient. When the finger tab is lifted forcefully because of difficulty in the pulling, the various projections and the cut portions on the crown cap itself and on the finger tab are all likely to cause cuts to fingers and uneasiness to the user. Furthermore, when the finger tab which has broken the crimped portion off is further pulled upward, the remainder crimped portion, that is, the remainder portion of the included teeth, is still hooked to the protruding ring at the mouth of the bottle and will thus require further application of force for pulling upward in order to separate the cap from the bottle mouth. Particularly, the said included teeth of the crimped portion that have been torn apart are of considerable sharpness, which, either during the opening of bottle or upon being discarded away, are likely to cause cuts to people. Still further, when the crown cap which has been torn open is to re-seal the mouth of the bottle, it requires that the parts which have been pulled open or the other deformed parts be made to return to their original condition in order to achieve the result of re-sealing of the bottle temporarily.

SUMMARY OF THE INVENTION

In view of the above shortcomings, an object of the present invention is to provide an easy opening crown cap where during its opening from the bottle damages to the crown cap will be kept to the minimum, that is, there being only one score line which passes from the edge of the crimped portion of the cap body to just beyond the peripheral curved portion, and whereby when the crown cap is pulled open, the split on the crown cap will not go beyond 5 mm in width and when the cap becomes separated out from the mouth of the bottle there will be almost no deformation in the crown cap.

A further object of the present invention is to provide an easy opening crown cap in which the finger tab is broadened in width and which, upon turning into a curved surface on being sealed to the mouth of a bottle becomes a rigid lug piece.

A further object of the present invention is to provide an easy opening crown cap in which the broadened finger tab has only one score line whereby forces can be focused on the one line, and also the score line is shortened to just pass across the curved portion and a small notch, from which the score line extends upwardly, is formed at the intersection point between the basal end of the finger tab and the crimped portion and at one or the other side of the finger tab.

An additional object of the present invention is to provide an easy opening crown cap which, owing to the small pulling force required to be applied with finger and the very little deformation resulting to the cap, is the most safe and easy to operate for people of all ages.

Another object of the present invention is to provide an easy opening crown cap in which the pulling over action not only breaks the crimped portion but is also able to push the cap off the mouth of the bottle.

A further object of the present invention is to provide an easy opening crown cap which, because of less damage and no deformation when being opened out from the bottle, can still be retained on the mouth of the bottle for temporary sealing of the bottle without having to reshape the cap.

BRIEF DESCRIPTION OF THE DRAWINGS

Other aspects and advantages of the present invention will become apparent from the following detailed description of a preferred embodiment thereof in connection with the accompanying drawings, in which.

DETAILED DESCRIPTION OF PREFERRED EMBODIMENTS OF THE INVENTION

Figure 1:
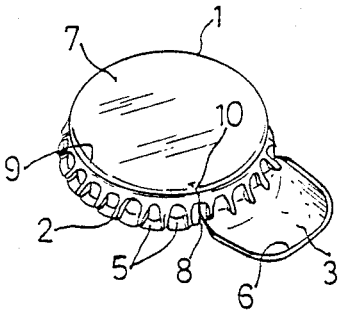
FIG. 1 is a perspective view of a crown cap constructed in accordance with the present invention, showing the cap prior to being sealed to a bottle.
Figure 3A:
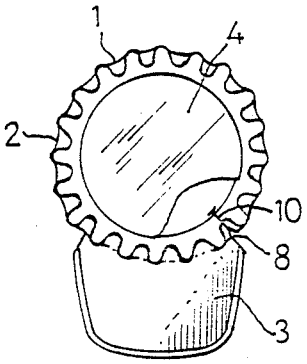
FIG. 3A is a top view of the crown cap shown in FIG. 2, the interior gasket partially cutaway and the score line defined on the right side thereof.
Figure 2:
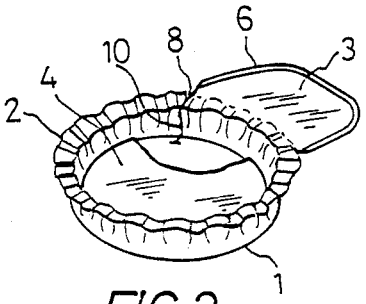
FIG. 2 is a perspective view of the crown cap of FIG. 1 after the cap has been turned over and the interior gasket partially cutaway.
Figure 3B:
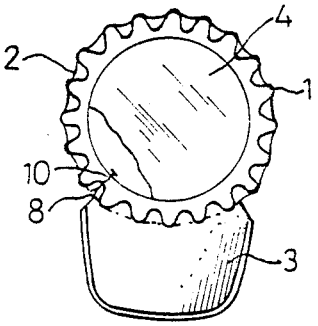
FIG. 3B is a top view of the crown cap shown in FIG. 2, the interior gasket partially cutaway and the score line defined on the left side thereof.
Figure 4A:
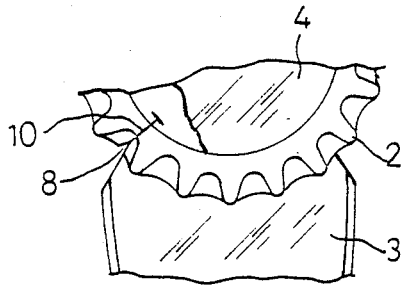
FIGS. 4A to 4I are schematic views of the crown cap having the essential portion partially cutaway and showing the score line formed in various ways of arrangement.
Figure 4B:
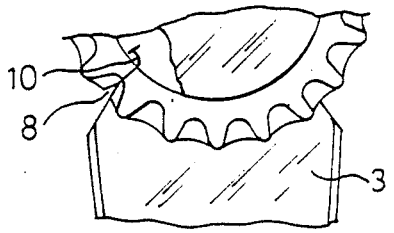
Figure 4C:
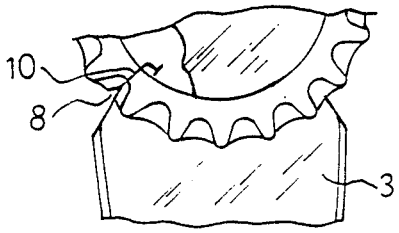
Figure 4D:
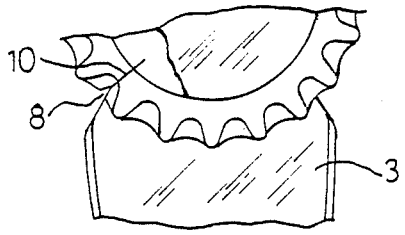
Figure 4E:
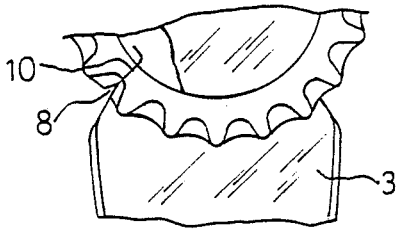
Figure 4F:
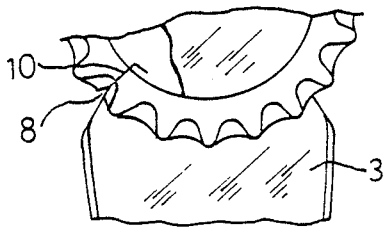
Figure 4G:
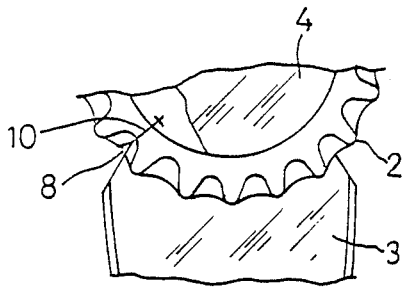
Figure 4H:
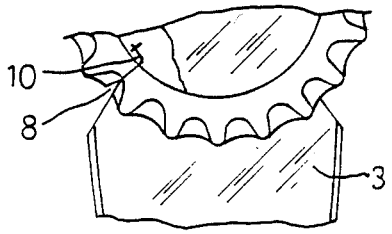
Figure 4I:
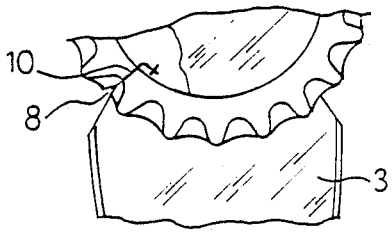
Figure 5:
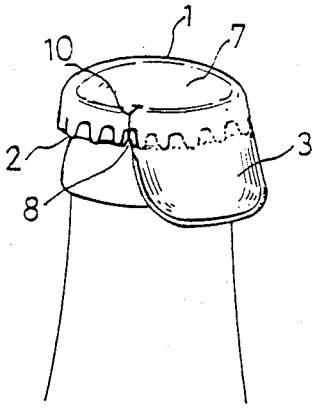
FIG. 5 is a perspective view of the crown cap after the cap has been sealed to the mouth of a bottle.

Referring now to FIGS. 1 through 3, there is shown the outer appearance of a crown cap of the present invention before sealing to a bottle, the crown cap including a cap body 1 having the periphery formed in a skirt with a crimped portion 2, a finger tab 3 extending outwardly from a part of the crimped portion 2 and a circular gasket 4 mounted on the inside surface of the cap body 1. The crimped portion 2, in general, has, as in a standard conventional crown cap, twenty-one included teeth 5. The finger tab 3 constitutes the essential part for efficiency of the crown cap of the present invention and in order to achieve the pull-to-open function, this finger tab 3 must be integrally joined to the crimped portion 2. To ensure that the finger tab 3 will not bend along the lower edge of the crimped portion 2, width of the finger tab 3 preferably extends across five to seven included teeth 5 or occupies about one-third of the periphery of the crown cap and the length of the finger tab 3 is about 2 to 3 times the height of the included teeth. Furthermore, the outer margin of the finger tab 3 is rolled over to form a pleated edge 6 to thereby strengthen the finger tab and prevent cuts to hands because of sharp edges. Before the crown cap is sealed to the mouth of a bottle, this finger tab 3 and the whole lower edge of the crimped portion 2 are located on about the same plane and together lie somewhat parallel to the flat top 7 of the cap, and also during this time, no hardness force is formed in the finger tab 3. However, when, a crown cap is compressed by a bottle capper, the finger tab 3 is pressed to assume an arched curvature shape as shown in FIG. 5, and consequently, hardness is greatly strengthened in the finger tab 3 whereby the tab forms a rigid pull piece. At the intersection point between the basal end of the finger tab 3 and the crimped portion 2 at one or the other side there is formed a small notch 8. This small notch 8 is shown to be broken at its tip in the drawings, but it may also be intact and be about to be broken at the tip. From the top end of this small notch 8 is provided a score line 10 which extends upwardly from the notch 8 along the crimped portion and passes across the peripheral curved portion 9 of the flat top 7 and terminates just inside the outer margin of the top portion of the flat top 7. The reason that this score line 10 must pass a little across the curved portion 9 is because the curved portion 9 is formed by stamping to form a reinforced portion which will not easily break upon being pulled open. Depending on quality of the material of the metal and thickness, the depth of the score line 10 generally is about half the thickness of the crown cap and should be appropriate if the score line can just be broken out on being pulled up. Although the crimped portion 2 is not directly concerned with air-tightness or fluid-tightness of the bottle, it will however increase the degree of easiness in the pulling open of the finger tab if the terminal end of score line 10 is cut to form a score line to extend towards the flat top from the small notch 8 along the intersection point between one side face of the finger tab and the crimped portion. Again, although the score line 10 may be formed on the outer surface or the inside of the crown cap, it will however be more particularly useful and of esthetical beauty if the said score line is defined on the inside where, because there is coverage of the gasket 4, the line will not be exposed. Furthermore, the shape and arrangement of the score line 10 may be such as shown in FIGS. 4A through 4I wherein the terminal end of the line assumes a T-shape with formation at the tip thereof of a short perpendicular score line or a straight line only or is curved slightly towards the right or the left after the score line has reached the flat top 7, or that the score line 10 with formation of the short perpendicular score line near the terminal end thereof assumes a cross-shape. This score line 10 may also vary in shape and arrangement in different ways. By such an arrangement and shape of the score line 10, it further facilitates the breaking off along the score line on pulling over and pushing open of the crown cap from the bottle.

Figure 6A:
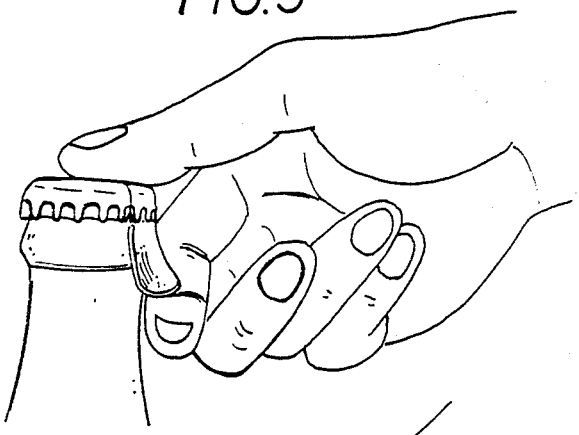
FIGS. 6A and 6B are schematic views showing stages of pulling the cap open from the mouth of the bottle in one embodiment.
Figure 6B:
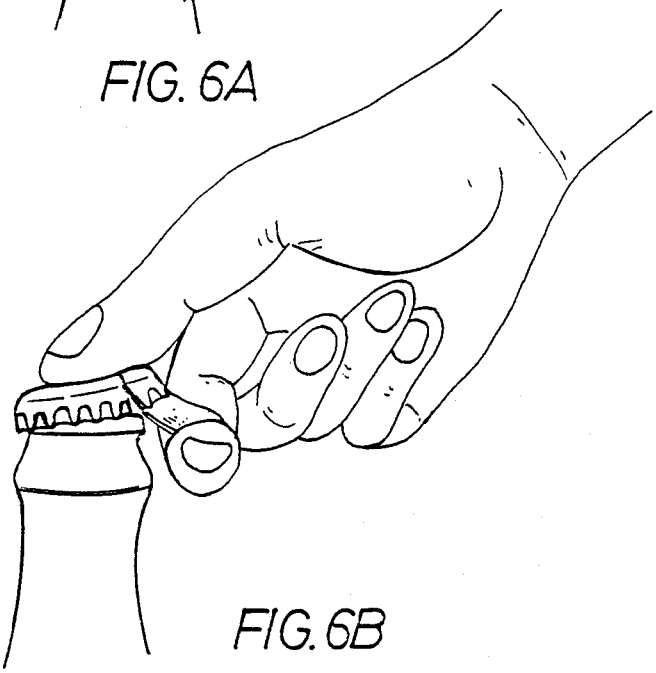
Figure 7A:
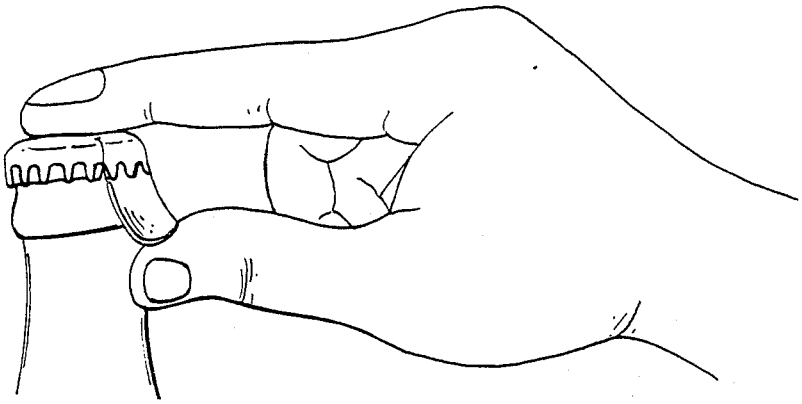
FIGS. 7A and 7B are schematic views showing stages of pulling the cap open from mouth of the bottle in another embodiment.
Figure 7B:
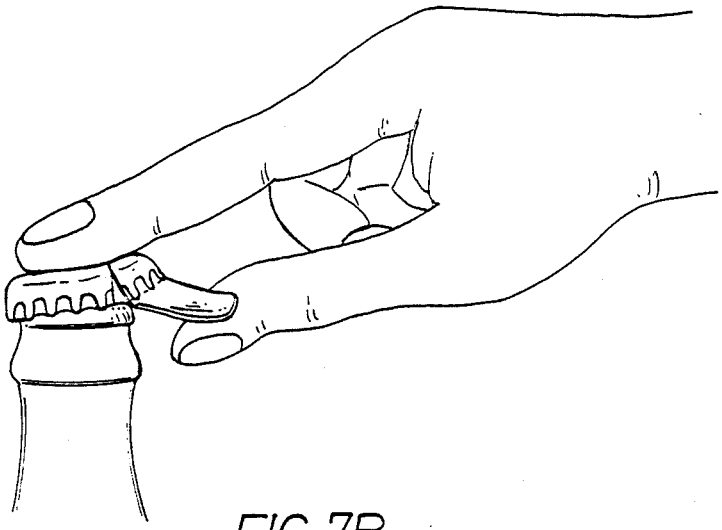

When a crown cap of the present invention which has been sealed to the mouth of a bottle as depicted in FIG. 5, is to be opened out from the bottle, this can be performed by pulling the finger tab 3 over with tip of the forefinger while the thumb being pressed against the flat top 7 as shown in FIGS. 6A and 6B, or the other way with tip of the thumb pulling the finger tab and the forefinger being pressed against the flat top as illustrated in FIGS. 7A and 7B. In whichever way it may be, when sufficient force has been applied by the finger, this force will focus on the weakest point of notch 8 of the score line 10, thereby breaking off the cap along the score line 10 up to the end portion of the line, that is, to the curved portion 9. This kind of destruction is a kind of breach rather than a tearing off, for there is still material around all sides of the crown cap and the cap is almost without any deformation. The splitting open of this score line 10 releases simultaneously the forces on the crimped portion 2 embracing the mouth of the bottle. At the same time, by way of the pulling over force, the valley of included teeth of the crimped portion is pulled over the protruding ring at the mouth of the bottle and the crown cap can thus be opened out with great ease. In accordance with the basic concept underlying the principle of the invention, it is only necessary to pull open a very small part of the crimped portion enough for the valley of included teeth to slip over the protruding ridge at the mouth of the bottle, whereas in the conventional type the opening is performed by tearing off the self open crown cap. According to the present invention, the rationale is therefore similar to the use of a cap opener in forcing the valley of included teeth to slip over the protruding ring at the mouth of the bottle. In use of the crown cap of the present invention, since damage and deformation is the least, the user will not have to worry about being accidentally cut. With regard to being easily opened on pulling over and having less damage and more safety in the operation, this crown cap should prove to be a most practically useful model.

I claim:

1. An easy opening cap comprising:

a substantially circular cap body having a substantially flat top portion and a portion formed about the circumference of said cap body and extending downwardly therefrom; and a finger tab having a proximal edge, a distal edge and two side edges and being integrally joined at its proximal edge to said downwardly extending portion of said cap body;

wherein a notch is formed at a lower edge of said downwardly extending portion adjacent one of said side edges of said finger tab, an elongated score line is formed in said cap body and extends from said notch upwardly and to a point on said substantially flat top portion, and only one such notch and elongated score line are formed in said cap body.

2. An easy opening cap as recited in claim 1, wherein said downwardly extending portion comprises a crimped portion.

3. An easy opening cap as recited in claim 1, wherein said finger tab is joined at its proximal edge to said downwardly extending portion along about a third of said circumference of said cap body.

4. An easy opening cap as recited in claim 1, wherein a pleat is formed along said distal edge and said side edges of said finger tab.

5. An easy opening cap comprising:

a substantially circular cap body having a substantially flat top portion and a portion formed about the circumference of said cap body and extending downwardly therefrom; and a finger tab having a proximal edge, a distal edge and two side edges and being integrally joined at its proximal edge to said downwardly extending portion of said cap body;

wherein a notch is formed at a lower edge of said downwardly extending portion adjacent one of said side edges of said finger tab, an elongated score line is formed in said cap body and extends from said notch upwardly and to a point on said substantially flat top portion, and a short score line is formed in said cap body and joins said elongated score line at said point on said substantially flat top portion and extends at an angle to said elongated score line.

6. An easy opening cap as recited in claim 5, wherein said short score line is substantially perpendicular to said elongated score line and forms a T-shape therewith.

7. An easy opening cap as recited in claim 5, wherein said short score line is substantially perpendicular to said elongated score line and forms a cross-shape therewith.

8. An easy opening cap as recited in claim 5, wherein said short score line forms a curved extension of said elongated score line.

9. An easy opening cap as recited in claim 5, wherein said downwardly extending portion comprises a crimped portion.

10. An easy opening cap as recited in claim 5, wherein said finger tab is joined at its proximal edge to said downwardly extending portion along about a third of said circumference of said cap body.

11. An easy opening cap as recited in claim 5, wherein a pleat is formed along said distal edge and said side edges of said finger tab.

12. An easy opening cap comprising:

a substantially circular cap body having a substantially flat top portion and a crimped portion formed about the circumference of said cap body and extending downwardly therefrom;

a finger tab having a proximal edge, a distal edge and two side edges and being integrally joined at its proximal edge to said crimped portion along less than a semi-circumference of said cap body; and wherein a notch is formed at a lower edge of said crimped portion adjacent one of said side edges of said finger tab, and a score line is formed in said cap body and extends from said notch upwardly and to a point on said substantially flat top portion.

13. An easy opening cap as recited in claim 12, wherein a pleat is formed along said distal edge and said side edges of said finger tab.

14. An easy opening cap as recited in claim 12, wherein said finger tab is joined at its proximal edge to said crimped portion along about a third of said circumference of said cap body.

15. An easy opening cap as recited in claim 12, wherein said crimped portion is formed with a plurality of teeth about its circumference.

16. An easy opening cap as recited in claim 12, wherein said crimped portion is formed with twenty-one teeth about its circumference, said finger tab is joined at its proximal edge to said crimped portion along five to seven of said twenty-one teeth and said finger tab has a length which is about two to three times the height of one of said teeth.

17. An easy opening cap as recited in claim 12, wherein only one notch and score line are formed in said cap body.

18. An easy opening cap as recited in claim 12, wherein said cap body has a thickness and said score line has a depth which is about half the thickness of said cap body.

* * * * *